US006286687B1

(12) United States Patent
Schuller

(10) Patent No.: US 6,286,687 B1
(45) Date of Patent: Sep. 11, 2001

(54) METHOD AND DEVICE FOR VIBRATION SCREENING

(75) Inventor: Franz Schuller, Mengkofen (DE)

(73) Assignee: DuPont Performance Caotings GmbH Co, KG (DE)

( * ) Notice: Subject to any disclaimer, the term of this patent is extended or adjusted under 35 U.S.C. 154(b) by 0 days.

(21) Appl. No.: 09/486,275

(22) PCT Filed: Aug. 26, 1998

(86) PCT No.: PCT/EP98/05421

§ 371 Date: May 8, 2000

§ 102(e) Date: May 8, 2000

(87) PCT Pub. No.: WO99/10111

PCT Pub. Date: Mar. 4, 1999

(30) Foreign Application Priority Data

Aug. 26, 1997 (DE) ..... 197 37 093

(51) Int. Cl.[7] ..... B07B 1/34
(52) U.S. Cl. ..... 209/325; 209/309; 209/326
(58) Field of Search ..... 209/309, 325, 209/326

(56) References Cited

U.S. PATENT DOCUMENTS 4,224,146 * 9/1980 Kent et al. ..... 209/243
5,037,536 * 8/1991 Koch et al. ..... 209/325

FOREIGN PATENT DOCUMENTS 270 476 A1 8/1989 (DE) .
195 34 629 A1 3/1997 (DE) .
0 611 605 A1 8/1994 (EP) .

OTHER PUBLICATIONS

Derwent WPI, "Power Coating Spray Cabin . . . Plastics Covered Light Frames", Abstract DD 270476 A.

Derwent WPI, "Swing Sieve for Classifying Particulates . . . and Working Cycle is Increased", Abstract DE 195 34 629 A.

Derwent WPI, "Powder Coating Appliancefor Workpieces . . . and Transportation System", Abstract DD 227 891 A.

* cited by examiner

*Primary Examiner*—Donald P. Walsh
*Assistant Examiner*—Mark J. Beauchaine
(74) *Attorney, Agent, or Firm*—Pillsbury Winthrop LLP

(57) ABSTRACT

Method and apparatus for the vibration screening of coating powders in particular, wherein a screening cloth is used, which is supported loosely on a screen frame and fixed to a clamping frame, wherein the screening cloth may additionally be supported on co-vibrating braces.

14 Claims, 2 Drawing Sheets

METHOD AND DEVICE FOR VIBRATION SCREENING

FIELD OF THE INVENTION

The invention relates to a method of screening bulk materials and liquids, in particular also coating powder particles, and to an apparatus for effecting the method.

Screening of bulk material is generally used to remove impurities (anti-fouling screening) as well as to separate bulk material into fractions of a specific particle size or of a specific particle size range (grading). Bulk materials may be, for example, granulates, powder and lacquers.

When manufacturing lacquers in powder form with the aid of extrusion techniques, the resulting coarse-grained material is ground and then undergoes a screening process, e.g. to remove unwanted oversize material and impurities.

Various screening techniques are known, wherein the screen may in addition also be excited at ultrasonic frequency.

Thus, for example, eddy current screens, wobble screens, vibrating wobble screens and turboscreens are known.

In the case of eddy current screens, the material to be screened is situated in a screening tube and pressed by a whirling motion against the screening cloth. Here, especially in the case of fine-grained material, clogging and hence impeding of the screening process may occur.

In the case of wobble and vibration screening, the screens which are used are set in motion e.g. by electromagnetic drives. The wobble screens operate with firmly clamped screens, which have to be clamped with a high expenditure of force over the screen frame.

Ultrasound may be applied to generate an additional vibration-like motion of the screening cloth. This leads to heating of the screening cloth with the result that, especially in the case of fine-grained material with a tendency to clog, the screening cloth may choke up completely.

With the described conventional screens, high costs are generally incurred by replacement covering and cleaning work owing to the amount of labour and time involved. The screening capacity does not reach the desired values.

DD-A 227 891 and DD-A 270 476 describe spraying cabins for powder coatings of workpieces, wherein the cabin floor is designed as a vibrating screen deck. The screen pack of said deck may, for example, have a diameter of 200 mm and a mesh width of 200 $\mu$m. An external vibration motor is used as a drive. The maximum amplitude of the screening process has a value of 0.2 mm, wherein the vibration is infinitely variable. A similar principle is described, for example, also in EP-A-0 611 605. The described screening apparatuses are installed as a compact structural unit directly in the spraying cabin and are used for the recovery and recirculation of powder overspray.

The screen decks require a complex construction to enable the necessary angle of inclination. They are not suitable for mobile use.

SUMMARY OF THE INVENTION

The object of the present invention is therefore to discover a method and an apparatus for the screening of coating powders, in particular, which enable an easy-to-operate and hence cost-saving screening process which is independent of special constructions, has a high screening capacity and entails a low and easily effected cleaning effort and expenditure of energy.

Said object is achieved by means of a technically simplified anti-fouling screening and grading method, which is characterized in that the screening cloth used for screening is held in a loose screen covering and during the screening process may be supported on a co-vibrating brace.

The invention therefore provides a method of screening by vibration screening, which is characterized in that a screening cloth is used, which is laid loosely onto a screen frame and fixed to a clamping frame, wherein the screening cloth may additionally be supported on a brace which co-vibrates with the screening cloth.

The screening cloth may be set in vibration-like motion by a conventional drive, e.g. a pneumatic, electric and/or hydraulic drive. Simultaneously with the screening cloth, the brace also co-vibrates. By virtue of the generated vibrating motion of screening cloth and brace, impurities or oversize material may be removed in a desired manner from a bulk material, e.g. coating powder particles, or a liquid material, e.g. A aqueous dispersion or suspension, deposited onto the screening cloth.

According to the invention, the anti-fouling screening or grading is effected by means of a loose screen covering. A loose screen covering means that the screening cloth lies loosely above a screen frame and is loosely fixed by a clamping frame on the screen frame. In said case, the clamping frame is simply laid on top of the screening cloth resting on the screen frame and is fixed between screen frame and clamping frame. Such a loose covering is intended merely to prevent slipping of the screening cloth. An additional tight clamping of the screening cloth by, for example, the additional action of lateral force upon the screening cloth is not necessary.

The co-vibrating brace according to the invention, on which the screening cloth may be supported during the screening process, is preferably integrated in the screen frame. The brace may be provided e.g. in the form of bars or grids in any desired manner, e.g. parallel or diagonally, on the screen frame and be made of any desired material.

It may also be situated as an independent component between screening cloth and screen frame, wherein the screening cloth is preferably situated above the brace.

The vibrating brace is designed and disposed in such a way that no impeding of the screening process and hence no impairment of the screening capacity arises, rather an intensification of the screening process and an increase of the screening capacity is achieved.

The brace is preferably installed in the screen frame situated below the screening cloth in the form of a bar disposed parallel to the screen frame or in the form of a plurality of bars.

During the screening process the screening cloth is preferably supported on the brace.

The usable drive is connected by suitable devices to the screening apparatus. Use is preferably made of an electrically controllable drive, for example, an unbalance motor.

In the case of an electric drive, the frequency of the motion may be controlled by a potentiometer and lie e.g. in a range of greater than 0 up to 480 Hz.

Control of the electric drive is preferably effected continuously.

The invention further provides a vibration screening apparatus, which is suitable for effecting the method according to the invention and is characterized in that it comprises a screening cloth, which is laid loosely on a screen frame and fixed to a frame (hereinafter referred to as clamping frame)

and which may be supported on a brace so designed that it may co-vibrate with the screening cloth. The clamping frame in said case serves merely to hold the screening cloth on the screen frame, without clamping of the screening cloth being required. The screening cloth is therefore provided with a low (loose) screen tension.

The apparatus according to the invention may in particular comprise a holding device, a lid with devices for the product feed, for the discharge and for the drive, as well as a screen frame with a screening cloth and a clamping frame.

DETAILED DESCRIPTION OF THE PREFERRED EMBODIMENTS

The accompanying drawings show exemplary constructional variants of the method according to the invention and of the apparatus according to the invention.

Figure 1:
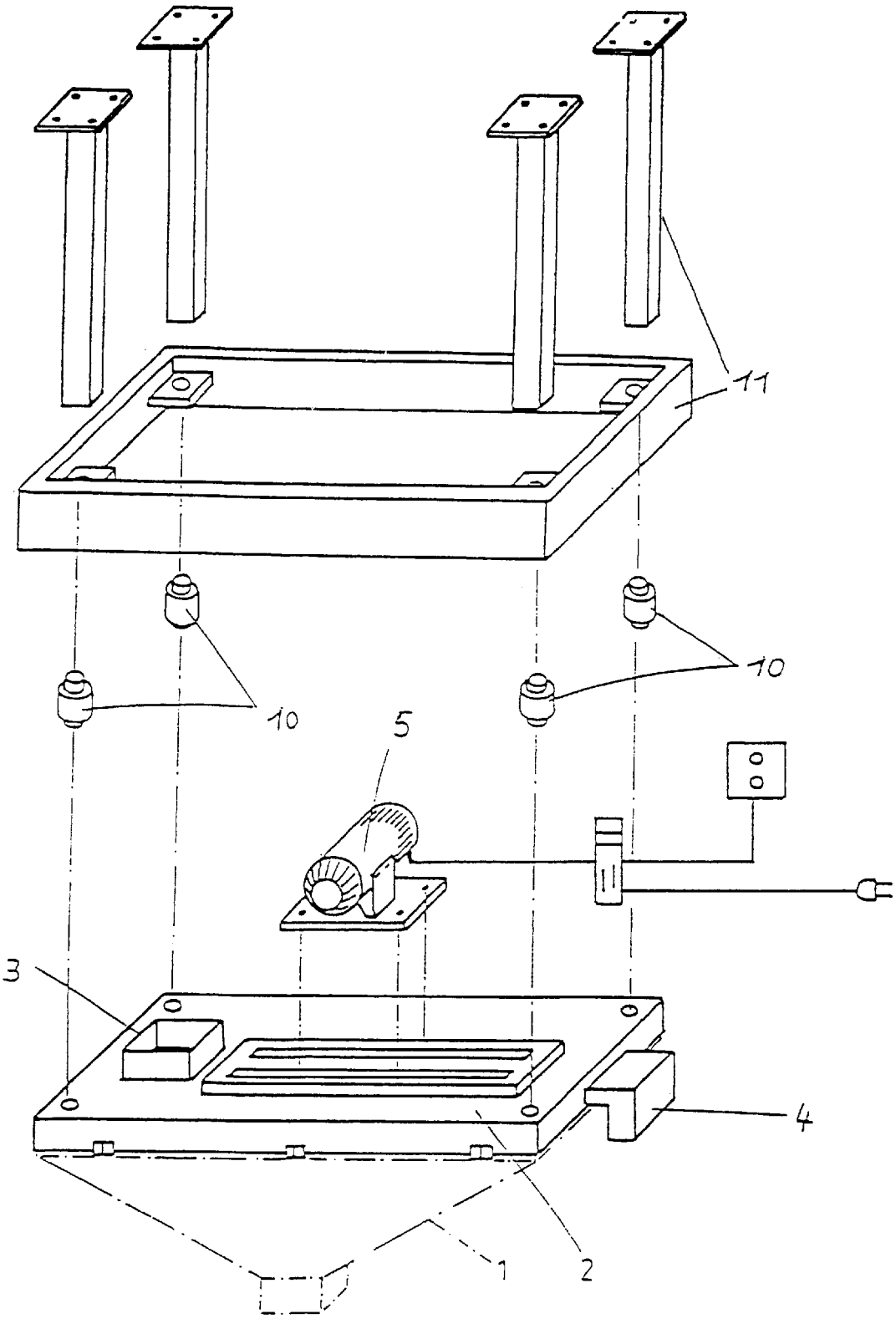
FIG. 1 shows, schematically, apparatus of the invention.

According to FIG. 1, a lid (2) having devices for the product feed (3) and for the discharge (4) is fitted on a holding device (1). Situated on the lid (2) is an unbalance motor (5), which is fitted on a sliding plate situated on the lid (2). The lid (2) connected to the holding device (1) is connected by rubber-metal connections (10) to the supporting frame (11).

Figure 2:
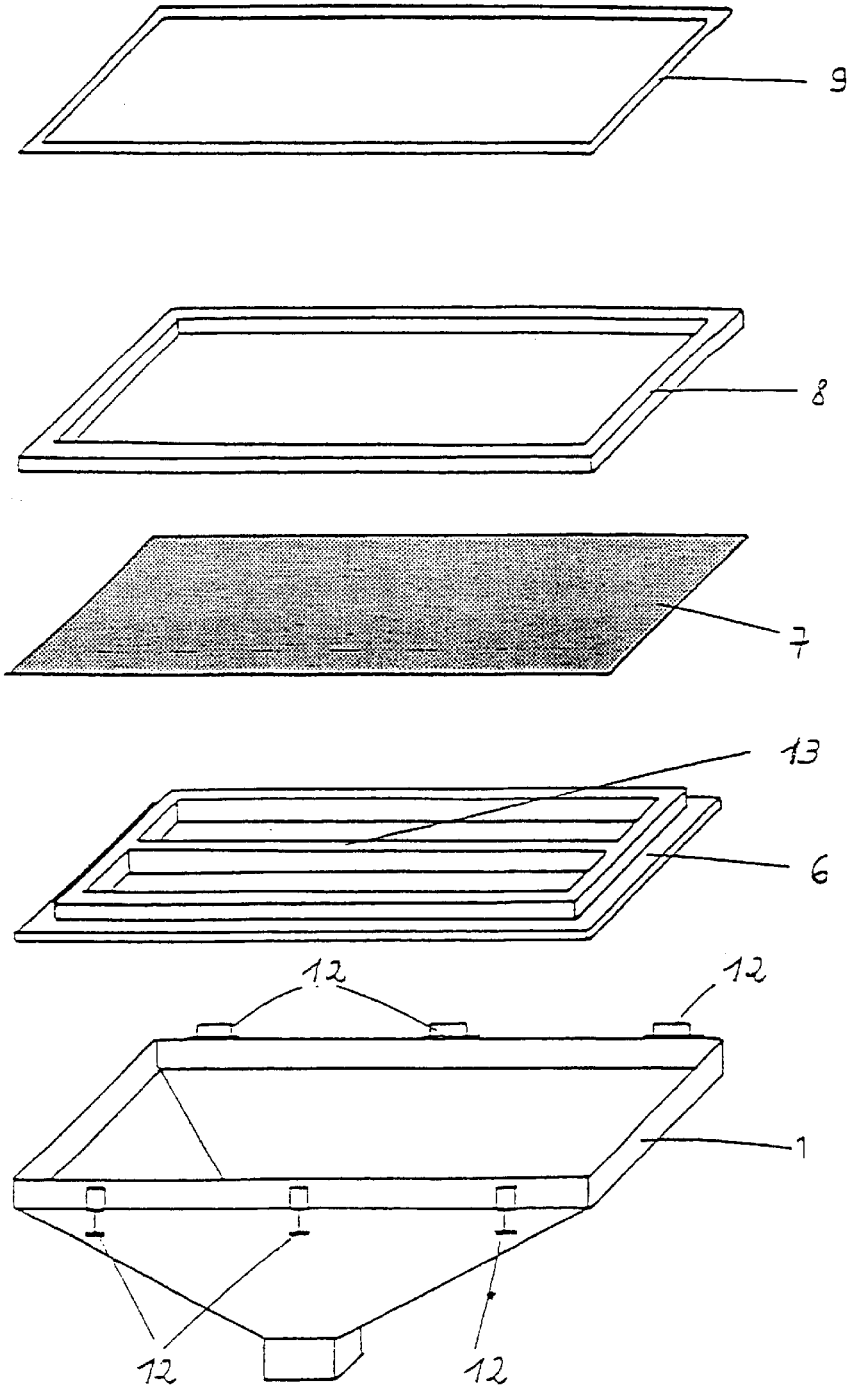
FIG. 2 shows an exploded view of a holding device of the invention.

FIG. 2 shows the holding device (1) with suitable closure devices, e.g. locking clamps with hinges (12) for the lid (2). The screening unit, comprising the screen frame (6), with the co-vibrating brace (13), the screening cloth (7) and the clamping frame (8), is inserted in the holding device (1). After insertion of the screening unit, a seal (9) is placed onto the holding device (1) before the holding device (1) containing the screening unit is closed by means of the lid (2). For improved understanding the invention is described below with reference to the numbering in FIGS. 1 and 2; however, it goes without saying that the style of construction of the embodiments illustrated by way of example in the drawings may be varied.

BACKGROUND OF THE INVENTION

The holding device (1) may be connected to or disposed above a funnel and the latter in turn may be connected to or disposed above a collecting container of any desired type and size. The inner wall of the funnel may have a smooth surface or grooves, flutes or similar structures extending in the direction of the tapering funnel opening for guiding the screened material. The holding device (1) may alternatively be connected to or disposed above any other conventional racking or collecting device.

The lid (2) situated on the holding device (1) is connected in a closing manner to the latter. This may occur through suitable conventional mechanical closures, for example, locking clamps, hook connections, screw connections and the like. Furthermore, closing of the holding device (1) with the lid (2) may, for example, be effected by applying a vacuum. What matters during closing is that holding device (1) and lid (2) are sealingly connected to one another. There is preferably situated between the holding device (1) and the lid (2) a seal (9) made of conventional material which may, for example, be 2 to 3 mm thick and self-adhesive.

The lid (2) is equipped with devices for the product feed (3), the discharge (4) and the drive (5).

The product feed (3) may comprise a fitting of any desired size and shape in the lid (2) and may be situated at any 35 desired point of the lid (2). The discharge (4) is used to remove unwanted screening material. The latter may, for example, be powder material of an undesired grain size, the so-called"coarse grain", or impurities. Furthermore, when screening liquid materials e.g. aqueous dispersions and suspensions, impurities may arise as undesired screening material. The discharge (4) is preferably situated on the lid (2) at the opposite side to the product feed device (3).

Also situated on the lid (2) are devices for the vibration drive (5). Said devices may e.g. supply devices for the conventional pneumatic, electric and/or hydraulic drive familiar to the person skilled in the art. The drive (5) may however alternatively be fastened directly to the lid (2) or to another point of the apparatus according to the invention. Preferably, use is made of an electric drive, in particular an unbalance motor. The latter may preferably be disposed directly on the lid (2) so as to be displaceable, e.g. on a sliding plate which in turn is fastened to the lid (2).

The holding device (1) contains the screen frame (6), the screening cloth (7) and the clamping frame (8). The screen frame (6) is used to receive the screening cloth (7), which is laid loosely on top. By means of the clamping frame (8) the screening cloth (7) is pressed manually onto the screen frame (6) and thereby loosely fixed between screen frame and clamping frame.

The screen frame (6) may comprise a co-vibrating brace (13), on which the screening cloth (7) may be supported during the screening process. The brace (13) may, as explained above, alternatively be installed as an additional element between screen frame (6) and screening cloth (7). It may comprise, for example, one or more bars disposed diagonally or parallel to the screen frame (6), or trellis-like grids.

The brace is preferably situated on the screen frame (6) in the form of 1 to 2 bars disposed parallel to the frame.

The screen frame (6), the brace (13) and the clamping frame (8) may be made of any desired material. Preferably they are made of metal.

The screening cloth may have any desired mesh width, depending on the screening requirements. For example, the screening mesh size may be up to 100 $\mu$m or 200 $\mu$m.

The material of the screening cloth may be, e.g. metal, plastic material or textile material, an additional possibility being blended fabrics.

High-grade steel or plastic screening cloths are preferably used.

Depending on requirements, the screen pack comprising screen frame (6), screening cloth (7) and clamping frame (8) may vary in diameter and be of any desired shape, e.g. rectangular, square or round. The lid (2) and the holding device (1) according to the invention may be adapted in accordance with the shape of the screen pack.

Surfaces of 0.1 to 1.5 $m^2$, for example, may be selected as active screening surfaces. Depending on requirements, smaller or larger formats may alternatively be selected.

The lid (2) firmly connectable to the holding device (1) may be connected by movable connecting pieces (10) to a supporting frame (11). The movable connecting pieces (10) are oscillating bodies which do not impede the undulating motion of the screening process. Said oscillating bodies may be, for example, rubber-metal connections, recirculating ball units or rubber packings. Suspensions are also usable, for example, through the use of tension or compression springs on the supporting frame (11). Preferably, rubber-metal connections are used.

The supporting frame (11) is used for fixed installation of the apparatus according to the invention, for example, on a wall or ceiling of the production area.

The supporting frame (11) with the connected screening unit may also be designed so as to be freely movable, e.g. on rollers, so that the screening apparatus according to the invention may be utilized in a spatially independent manner, depending on local requirements.

For the screening process, the screening unit comprising screen frame (6), screening cloth (7), clamping frame (8) as well as optionally the seal (9) is inserted into the holding device (1) and the latter is closed with the lid (2). Introduction of the material to be screened is effected through the product feed (3). The screening unit with the screening cloth (7) situated in the screening unit and with the co-vibrating brace (13) is set in vibration-like motion by the drive (5) and so the material situated on the screening cloth is moved and fractionated in accordance with the selected screening mesh width. The screening material is collected, for example, in a collecting container.

The generated vibration-like motion of the screening unit moreover leads to a movement of the screening material, in particular the bulk material, on the screening cloth (7) in a specific direction. The direction of movement of the screening material may be controlled by the operating mode of the drive (5) Preferably, the direction of movement is controlled in such a way that the screening material, in particular the bulk material, is moved during the screening process in the direction of the discharge (4). In said manner, the unwanted material left behind on the screening cloth (7) may be removed through the discharge (4).

Simultaneously with the screening process according to the invention, a complete removal of the residual screening material from the surface of the screening cloth may be achieved by the generated motion of the screening cloth. Said "self-cleaning effect" may be proportionally increased through suitable control of the motion by the drive (5). For example, to said end the drive (5) may be displaced on the lid (2) by means of a sliding plate.

The method and apparatus according to the invention may be used to screen, in particular, bulk materials of any desired type and shape. They are particularly suitable for screening coating powder particles. A screening process is enabled, which allows both a grading of the powder material to be screened as well as a removal of impurities (anti-fouling screening).

It is moreover also possible with the method and apparatus according to the invention to remove impurities or coarser components from liquid materials, e.g. aqueous dispersions or suspensions.

By virtue of the method and apparatus according to the invention a simpler and hence cost-saving screening process is achievable, whereby especially bulk materials, for. example, powder particles and in particular coating powder particles, may be produced in the desired grain size at a high screening rate. For example, specific screening capacities under production conditions greater than 1800 kg/h $m^2$ are achievable; in the case of problematical coating powder products such as, e.g. matt structural coating powders, a specific screening capacity greater than 1000 kg/h $m^2$ is high compared to screening machines of prior art.

Furthermore, a consistently good product quality is guaranteed because heat generation, conglutination or clogging caused, for example by rotating or rubbing parts may be avoided. The screening process according to the invention moreover enables a periodically effective cleaning of the screen covering. For example, the cleaning time upon a change of product is only around 20 to 25% compared to conventional screening processes. The screening apparatus according to the invention may, without technical aids, be dismantled, cleaned and reassembled within a very short time. Through manual insertion of the screening cloth (7) between screen frame (6) and clamping frame (8), as already explained, an easily effected fixing of the screening cloth (7) is achieved without additional tight clamping of the screening cloth in a horizontal plane. A comparatively low height of the screen means, for example, that there is no need for metering screws, such as are used in the conventional screening machines. The invention is described by way of an example:

Example

A coating powder manufactured by a conventional powder extrusion method is subjected to screening after conventional grinding to grain sizes in the region of 5 $\mu$m to 120 $\mu$m. For comparison, screening is effected using the methods of known prior art as well as the method according to the invention. Screens with a mesh width of 160 $\mu$m were used.

The following table presents a comparison of the results obtained:

| | Conventioanl Screening Apparatus | | | | Screening apparatus acc. to invention |
|---|---|---|---|---|---|
| Energy consumption | 2500 watts | 2100 watts | 3000 watts | 4500 watts | 260 watts |
| Active screening surface | 2.0 $m^2$ | 0.8 $m^2$ | 0.32 $m^2$ | 0.64 $m^2$ | 0.46 $m^2$ |
| Max. screening capacity | up to 400 kg/h | up to 2500 kg/h | up to 400 kg/h | up to 1000 kg/h | >1000 kg/h |
| Specific screening capacity | 200 kg/h $m^2$ | 313 kg/h $m^2$ | 1250 kg/h $m^2$ | 1563 kg/h $m^2$ | 2174 kg/h $m^2$ |
| Type of cleaning | ultrasound | ultrasound | mechanical | mechanical | mechanical |
| Cleaning time | ca. 120 min. | ca. 60 min. | ca. 20 min. | ca. 30 min. | 5 min. |
| Recovering | by specialist | by specialist | self/ca. 15 | self/ca. 30 | self/5 min. |

-continued

| | Conventioanl Screening Apparatus | | | | Screening apparatus acc. to invention |
|---|---|---|---|---|---|
| screen frame/ duration | company | company | min. | min. | |
| Unit cost of screen covering | DM1800 | DM700 | DM45 | DM90 | DM20 |
| Unit cost of screen frame | DM10800 | DM4500 | DM1200 | DM2400 | DM100 |
| Oversize losses | yes | yes | yes | yes | no |
| Compressed-air consumption | n/a | n/a | ca. 1 $m^3/h$ | ca. 2 $m^3/h$ | n/a |

The conventional screening apparatus are standard screening machines of the type which, according to current prior art, are available for screening coating powders, in particular.

The active screening surface is the screening surface actually available for the screening process.

The specific screening capacity arises from the ratio of active screening surface and screening capacity for a given mesh width.

It may be established that the specific screening capacity given application of the invention, despite a lower active screening surface, presents substantially higher values than that of conventional screening machines.

Furthermore, the—compared to the invention—high expenditure for cleaning the screen, for the screen covering and the renewal of the screen frame is documented.

On the whole it may be established that, compared to the known prior art, by virtue of screening with simultaneous application of the invention a higher specific screening capacity is achievable while at the same time reducing the energy consumption and the cost of cleaning and renewing screening machine parts.

What is claimed is:

1. Method of screening by vibration screening, wherein a screening cloth is used, which is laid loosely onto a screen frame and fixed to a clamping frame, wherein the screening cloth may additionally be supported on a brace which co-vibrates with the screening cloth.

2. Method according to claim 1, wherein the vibration screening is generated by a pneumatic, hydraulic or electric drive.

3. Method according to claim 1, wherein by virtue of the vibration screening both the screening cloth and the brace are set in vibrating motion.

4. Method according to claim 1, wherein the direction of movement of the screening material on the screening cloth is controlled by means of a drive.

5. Method according to claim 4, wherein the movement of the screening material is controlled by the direction of rotation of an electric drive.

6. Method according to claim 1, wherein as screening material bulk materials in the form of powder particles, in particular coating powder particles, and liquid materials, e.g. aqueous dispersions or suspensions, are used.

7. Method according to claim 1, wherein an anti-fouling screening of bulk materials and liquid materials as well as a grading of bulk materials is effected.

8. Vibration screening apparatus for effecting the method according to claim 1, comprising a screening cloth (7), which is laid loosely onto a screen frame (6) and fixed to a clamping frame (8) and which may be supported on a brace (13) so designed that it may co-vibrate with the screening cloth.

9. Apparatus according to claim 8, wherein the brace (13) comprises one or two bars disposed parallel to the frame (6).

10. Apparatus according to claim 8, comprising a holding device (1), a lid (2) lying thereon with devices for the product feed (3), for the discharge (4) and for the drive (5), wherein the screen frame (6) is supported on the holding device.

11. Apparatus according to claim 10, wherein the lid (2) is firmly connectable to the holding device (1).

12. Apparatus according to claim 10, wherein the lid (2) firmly connectable to the holding device (1) is connected by one or more movable connecting pieces (10) to a supporting frame (11).

13. Apparatus according to claim 10, wherein the discharge (4) is disposed at the other end of the lid (2) opposite the product feed (3).

14. Apparatus according to claim 10, wherein the screen covering of the screening cloth (7) is loose between screen frame (6) and clamping frame (8).

* * * * *